US006712629B1

(12) United States Patent
Alexander et al.

(10) Patent No.: US 6,712,629 B1
(45) Date of Patent: Mar. 30, 2004

(54) APPARATUS AND METHOD OF MAKING AN ELECTRICAL CONNECTION IN A HIGH VOLTAGE/HIGH CURRENT LAMP

(75) Inventors: Charles Alexander, Cincinnati, OH (US); Mark Tausch, West Chester, OH (US); Thomas Wallenhorst, Liberty Township, OH (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 10/284,487

(22) Filed: Oct. 31, 2002

Related U.S. Application Data

(60) Provisional application No. 60/418,193, filed on Oct. 15, 2002.

(51) Int. Cl.[7] ..... H01R 33/02
(52) U.S. Cl. ..... 439/244; 439/240
(58) Field of Search ..... 439/240, 241, 439/239, 244, 243

(56) References Cited

U.S. PATENT DOCUMENTS 3,060,310 A * 10/1962 Bertsche, Jr. et al. ..... 439/243
3,122,405 A * 2/1964 Pistey ..... 439/244
3,263,201 A * 7/1966 Pistey ..... 439/244
3,329,924 A * 7/1967 Henshaw, Jr. ..... 439/244
5,552,927 A 9/1996 Wheatly et al.
5,723,937 A 3/1998 Whitman et al.
6,124,600 A 9/2000 Moroishi et al.
6,200,005 B1 3/2001 Roberts et al.

FOREIGN PATENT DOCUMENTS

JP 04-295801 10/1992
JP 11-097732 4/1999
JP 2001-296607 10/2001

* cited by examiner

*Primary Examiner*—Gary Paumen
(74) *Attorney, Agent, or Firm*—Foley & Lardner

(57) ABSTRACT

A housing is provided in which a first electrical connector is positioned, the first connector being connected to a power supply. A second electrical connector is designed to be received by the housing so that a substantially stable and continuous electrical connection is established between the first and second electrical connectors.

32 Claims, 10 Drawing Sheets

APPARATUS AND METHOD OF MAKING AN ELECTRICAL CONNECTION IN A HIGH VOLTAGE/HIGH CURRENT LAMP

CROSS-REFERENCE TO RELATED APPLICATIONS

This application claims priority to U.S. Provisional Patent Application Ser. No. 60/418,193, filed on Oct. 15, 2002, the contents of which are hereby incorporated by reference.

BACKGROUND OF THE INVENTION

1. Field of the Invention

The present invention relates to electrical connections in lamps. More particularly, the invention relates to the connections for lamps which experience high voltage and/or high current.

2. Description of the Related Art

Arc lamps experience high current (e.g., such as up to about 15 A at low voltage) and high voltage (e.g., 800 V at low current). As a result of the power drain associated with this voltage, the exterior of the lamp can reach temperatures around 850° C.

Currently, there are two methods of making the electrical connection to an arc lamp which will deliver the necessary power to the lamp. A first prior art method is shown in FIGS. 7A, 7B in which a lamp electrode 105 is enclosed in one end of the lamp enclosure 106. It is to be understood that the electrical connection may be the same at the other end of the lamp 106. According to this method, the lamp electrode 105 is terminated inside an end fitting 102. This end fitting is preferably formed of a ceramic insulating material.

The electrode 105 projecting from the lamp 106 is received within the end fitting 102 and electrically engages a power line 104 along a weld joint 101. The electrode 105 and lamp 106 are held in place in end fitting 102 using non-conductive potting material 128. The power line 104, which is preferably a high-temperature wire of about 8"–14" in length, is flexible and is wrapped in a high-temperature insulation 108 at substantially all points between the weld joint 101 and an electrical connector 107 which is provided at a distal end of the power line 104 and which has a hole therein.

As shown in FIG. 7B, the connector 107 is adapted to receive a metal fastener 109 which may be in the form of a screw, as shown. The fastener 109 also receives a similar electrical connector 114 of a second power line 116 which is integrally connected to a power source and which is also preferably wrapped in high-temperature insulation 108. When the fastener 109 receives both electrical connectors 107, 114, an electrical connection is established between the first power line 104 and the second power line 116. Further, to maintain the electrical connection, the fastener 109 is fastened to a standoff 110 which is connected to the lamp housing 112, e.g., the fastener 109 may be screwed into the standoff 110.

In the second method, which is shown in FIGS. 8A and 8B, an internal electrical connection is made between a metallic end fitting 130 and a lamp electrode 105 projecting from one end of a lamp 106. It is to be understood that the connection may be the same at the other end of the lamp 106. The electrode 105 is received by the metallic end fitting 130 thereby establishing an electrical connection 126 between the electrode 105 and the end fitting 130 which is preferably formed of metal. Electrode 105 and lamp 106 are held in place to end fitting 130 using nonconductive potting material 128.

The end fitting 130 is received within a recess 137 formed in an insulating block 134 which is preferably formed out of a ceramic material. Positioned in the recess 137 is a proximal end 142 of a power line 140 which is preferably a high-temperature wire. Substantially all of the power line extending beyond the insultating block 134 is wrapped in a high-temperature insulation 108. When the end fitting 130 is received in the recess 137, the outer collar of the metallic end fitting 130 contacts the distal end 142 of the power line 140 thereby electrically connecting the power line 140 and the electrode 105.

A clamp 131, such as a c-shaped clamp, may be positioned on top of the end fitting 130 to hold the end fitting 130 in the recess 137. Without a clamp, the electrical connection between the end fitting 130 and the power source will be unstable. Accordingly, fasteners 139 are typically used to lock the clamp 131 onto the block 134; the fasteners may pass through holes 133 in the clamp 131 and be received in bores 135 in the block 134. A distal end 143 of the power line 140 is connected to an electrical connector 144 which is adapted to be connected to a power source.

Unfortunately, the first of the aforementioned methods of supplying power to the lamp requires the use of insulating standoffs 110 configured with threaded holes in which the fasteners 109 connect the lamp wire with the wire from the power source. In the second method, to establish a stable connection, fasteners 139 and a clamp 131 must be employed to lock the end fitting into the insulating block 134. Thus, although two solutions currently exists to transmit power to an arc lamp, the solutions require the use of additional parts which have a cost associated therewith. In addition, the connections require the fastening and unfastening of fasteners (e.g., turning of the screws) which is not only time consuming, it is also problematic as the fastener or standoff may be damaged. For example, the threads of the screw may become stripped thereby making the connection unstable and/or difficult to disconnect.

In light of the aforementioned, it is desired to achieve one or more of the following in a new apparatus and method for an electrical connection: (a) effectively transmit power to an arc lamp; (b) reduce the number of necessary parts and/or production costs; and/or (c) easily establish and disestablish an electrical connection in an arc lamp.

SUMMARY OF THE INVENTION

The invention herein contains multiple embodiments including a connective apparatus for an electrical connection, the apparatus including: (a) a housing including: (1) a bore through the housing which is adapted to receive an arc lamp end fitting having a female electrical connector projecting therefrom; and (2) an electrical connector container having one end in communication with the bore; and (b) a male electrical connector provided in the electrical connector container, wherein a first portion of the male electrical connector is adapted to engage electrically the female electrical connector, and wherein a second portion the male connector is electrically connected to a power supply.

In another embodiment of the connective apparatus, the electrical connector container may be substantially transverse to the bore.

In another embodiment of the connective apparatus, the male electrical connector may include a spring provided adjacent the second portion.

In another embodiment of the connective apparatus, the male electrical connector may include a spring provided adjacent the second portion, wherein the first portion of the male electrical connector may be biased by the spring toward the bore.

In another embodiment of the connective apparatus, the male electrical connector may include a spring provided adjacent the second portion, wherein the first portion of the male electrical connector may be biased by the spring toward the bore. In this embodiment, when the arc lamp end fitting is positioned in the bore, the first portion of the male connector, which electrically engages the female electrical connector, may be adapted to be driven downward in the electrical connector container by the female electrical connector.

In another embodiment of the connective apparatus, the electrical connection between the second portion of the male connector and the power supply may not be readily disengaged.

In another embodiment of the connective apparatus, the second portion of the male connector may be integrally connected to the power supply.

In another embodiment of the connective apparatus, the housing may be formed of a nonconductive material.

In another embodiment of the connective apparatus, a front side of the housing may have a gap formed therein which extends into the bore and which may be adapted to receive the female electrical connector.

In another embodiment of the connective apparatus, the female electrical connector may include a socket which may be adapted to receive and to engage electrically the male electrical connector.

Another embodiment of the invention pertains to an arc lamp apparatus which includes: (a) an arc lamp including: (1) a first end including a first arc lamp end fitting having a first female electrical connector projecting therefrom; (2) a second end; and (3) a light emitting portion positioned between the first and second ends; (b) a first connective apparatus including: (1) a first housing including: (A) a first bore through the first housing in which the first arc lamp end fitting is positioned; and (B) a first electrical connector container having one end in communication with the first bore; and (2) a first male electrical connector provided in the first container, wherein a first portion of the first male electrical connector electrically engages the first female electrical connector, and wherein a second portion the first male connector is electrically connected to a power supply.

In another embodiment of the arc lamp apparatus, the first electrical connector container may be substantially transverse to the first bore.

In another embodiment of the arc lamp apparatus, the first male electrical connector may include a spring provided adjacent the second portion thereof.

In another embodiment of the arc lamp apparatus, the first male electrical connector may include a spring provided adjacent the second portion thereof, wherein the first portion of the first male electrical connector may be biased by the spring toward first bore of the first housing.

In another embodiment of the arc lamp apparatus, the second end of the arc lamp may include a second arc lamp end fitting having a second female electrical connector projecting therefrom, and wherein the arc lamp apparatus may further include: (c) a second connective apparatus including: (1) a second housing including: (A) a second bore through the second housing in which the second arc lamp end fitting is positioned; and (B) a second electrical connector container having one end in communication with the second bore; and (2) a second male electrical connector provided in the second container, wherein a first portion of the second male electrical connector may electrically engage the second female electrical connector, and wherein a second portion the second male connector may be electrically connected to the power supply.

In another embodiment of the arc lamp apparatus, the second end of the arc lamp may include a second arc lamp end fitting having a second female electrical connector projecting therefrom, and wherein the arc lamp apparatus may further include: (c) a second connective apparatus including: (1) a second housing including: (A) a second bore through the second housing in which the second arc lamp end fitting is positioned; and (B) a second electrical connector container having one end in communication with the second bore; and (2) a second male electrical connector provided in the second container, wherein a first portion of the second male electrical connector may electrically engage the second female electrical connector, wherein a second portion the second male connector may be electrically connected to the power supply, and wherein the second male electrical connector may include a spring provided adjacent the second portion thereof.

In another embodiment of the arc lamp apparatus, the second end of the arc lamp may include a second arc lamp end fitting having a second female electrical connector projecting therefrom, and wherein the arc lamp apparatus may further include: (c) a second connective apparatus including: (1) a second housing including: (A) a second bore through the second housing in which the second arc lamp end fitting is positioned; and (B) a second electrical connector container having one end in communication with the second bore; and (2) a second male electrical connector provided in the second container, wherein a first portion of the second male electrical connector may electrically engage the second female electrical connector, wherein a second portion the second male connector may be electrically connected to the power supply, wherein the second male electrical connector may include a spring provided adjacent the second portion thereof, and wherein when the first arc lamp end fitting is positioned in the first bore of the first housing, the first portion of the first male connector, which electrically engages the first female electrical connector, may be driven downward in the first container of the first housing by the first female electrical connector.

In another embodiment of the arc lamp apparatus, the second end of the arc lamp may include a second arc lamp end fitting having a second female electrical connector projecting therefrom, and wherein the arc lamp apparatus may further include: (c) a second connective apparatus including: (1) a second housing including: (A) a second bore through the second housing in which the second arc lamp end fitting is positioned; and (B) a second electrical connector container having one end in communication with the second bore; and (2) a second male electrical connector provided in the second container, wherein a first portion of the second male electrical connector may electrically engage the second female electrical connector, wherein a second portion the second male connector may be electrically connected to the power supply, and wherein the electrical connections between the second portions of the first and second male connectors and the power supply may not be readily disengaged.

In another embodiment of the arc lamp apparatus, the second end of the arc lamp may include a second arc lamp end fitting having a second female electrical connector projecting therefrom, and wherein the arc lamp apparatus may further include: (c) a second connective apparatus including: (1) a second housing including: (A) a second bore through the second housing in which the second arc lamp end fitting is positioned; and (B) a second electrical connector container having one end in communication with the second bore; and (2) a second male electrical connector provided in the second container, wherein a first portion of the second male electrical connector may electrically engage the second female electrical connector, wherein a second portion the second male connector may be electrically connected to the power supply, and wherein the second portions of the first and second male connectors may be integrally connected to the power supply.

In another embodiment of the arc lamp apparatus, the second end of the arc lamp may include a second arc lamp end fitting having a second female electrical connector projecting therefrom, and wherein the arc lamp apparatus may further include: (c) a second connective apparatus including: (1) a second housing including: (A) a second bore through the second housing in which the second arc lamp end fitting is positioned; and (B) a second electrical connector container having one end in communication with the second bore; and (2) a second male electrical connector provided in the second container, wherein a first portion of the second male electrical connector may electrically engage the second female electrical connector, wherein a second portion the second male connector may be electrically connected to the power supply, and wherein the first and second housings may be formed of a nonconductive material.

The invention also contemplates a method of connecting an arc lamp to a power supply, the method including: (a) moving a first end of an arc lamp through a first bore in a first housing, the first end of arc lamp comprising a first arc lamp end fitting having a first female electrical connector projecting therefrom; (b) moving the first end of the arc lamp into a second bore in a second housing; (c) moving a second end of the arc lamp into the first bore in the first housing, the second end of the arc lamp comprising a second arc lamp end fitting having a second female electrical connector projecting therefrom; (d) aligning the first female electrical connector with a slot in the second housing while simultaneously aligning the second female electrical connector with a slot in the first housing; (e) rotating the arc lamp so as to position the first female electrical connector in the slot in the second housing and so as to position the second female electrical connector in the slot in the first housing; (f) engaging, electrically, the first female electrical connector with a first male electrical connector in the second housing, wherein the first male electrical connector is electrically connected to a power source; and (g) engaging, electrically, the second female electrical connector with a second male electrical connector in the first housing, wherein the second male electrical connector is electrically connected to the power source.

In another embodiment of the method of connecting an arc lamp to a power supply, the first female electrical connector may include a socket which electrically engages the first male electrical connector, and wherein the second female electrical connector may include a socket which electrically engages the second male electrical connector.

In another embodiment of the method of connecting an arc lamp to a power supply, the first male electrical connector may be provided in the slot in the second housing, and wherein the second male electrical connector may be provided in the slot in the first housing.

The invention also contemplates a method of connecting one end of an arc lamp to a power supply, the method including: (a) moving an arc lamp end fitting projecting from the end of the arc lamp into a bore in a housing, wherein the arc lamp end fitting has a female electrical connector projecting therefore; (b) aligning the female electrical connector with an electrical connector container in the housing, wherein a male electrical connector is provided in the electrical connector container; (c) rotating the arc lamp so as to force the female electrical connector into the electrical connector container; (d) contacting the female electrical connector and the male electrical connector; and (e) establishing an electrical connection between the male electrical connector and the female electrical connector.

In another method of connecting one end of an arc lamp to a power supply, the step of contacting the female and male electrical connectors may include: (d1) compressing a spring provided below the male electrical connector in the housing.

In another method of connecting one end of an arc lamp to a power supply, the male electrical connector may be connected to a power supply.

In another method of connecting one end of an arc lamp to a power supply, the step of establishing an electrical connection between the male and female electrical connectors may include: (e1) moving an end portion of male electrical connector into a socket formed in an end of the female electrical connector.

The invention also contemplates a method of connecting one end of an arc lamp to a power supply, the method including: (a) positioning an arc lamp end fitting projecting from the end of the arc lamp against a gap in a housing, wherein a bore is provided behind the gap, wherein the arc lamp end fitting has a female electrical connector projecting therefore; (b) pushing the arc lamp end fitting through the gap and into the bore; (c) aligning the female electrical connector with an electrical connector container in the housing, wherein a male electrical connector is provided in the electrical connector container; (d) rotating the arc lamp so as to force the female electrical connector into the electrical connector container; (e) contacting the female electrical connector and the male electrical connector; and (f) establishing an electrical connection between the male electrical connector and the female electrical connector.

In further method of connecting one end of an arc lamp to a power supply, the step of contacting the female and male electrical connectors may include: (e1) compressing a spring provided below the male electrical connector in the housing.

In further method of connecting one end of an arc lamp to a power supply, the male electrical connector may be connected to a power supply.

In further method of connecting one end of an arc lamp to a power supply, the step of establishing an electrical connection between the male and female electrical connectors may include: (f1) moving an end portion of male electrical connector into a socket formed in an end of the female electrical connector.

In further method of connecting one end of an arc lamp to a power supply, the housing may be formed of a pliable material, and wherein the step of pushing the arc lamp end fitting through the gap and into the bore may include: (b1) expanding a width of the gap to be as wide as a width of the arc lamp end fitting; (b2) moving the arc lamp end fitting into the bore; and (b3) returning the gap to its original width.

These and other features, aspects, and advantages of the present invention will become more apparent from the following description, appended claims, and accompanying exemplary embodiments shown in the drawings.

BRIEF DESCRIPTION OF THE DRAWINGS

The accompanying drawings, which are incorporated in and constitute a part of the specification, illustrate an embodiment of the invention and together with the description, serve to explain the principles of the invention.

DETAILED DESCRIPTION

Figure 1:
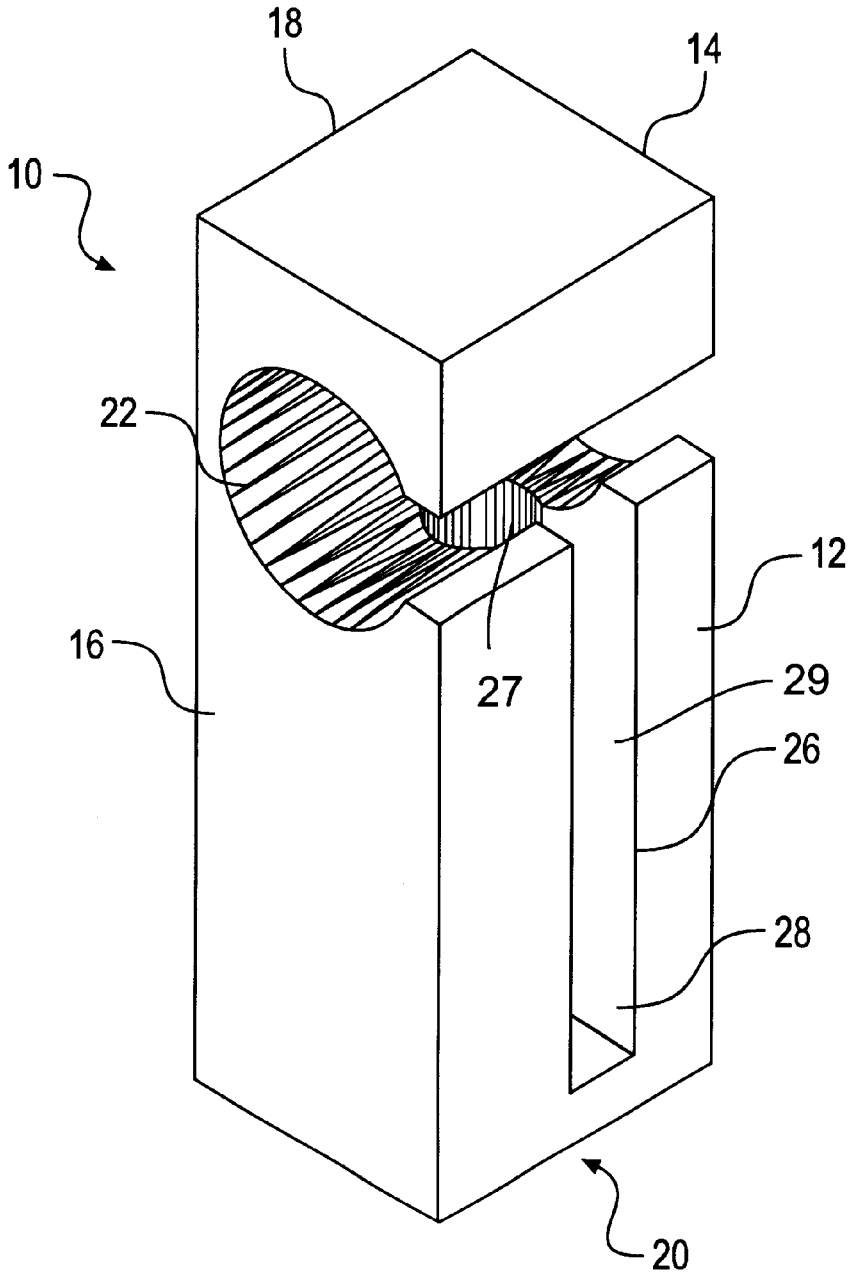
FIG. 1 is a perspective view of a connective housing in accordance with a preferred embodiment of the present invention.

Reference will now be made in detail to presently preferred embodiments of the invention, which are illustrated in the drawings. An effort has been made to use the same reference numbers throughout the drawings to refer to the same or like parts.

FIG. 1 is perspective view of a connective housing 10 in accordance with a first embodiment of the present invention. The housing 10, which is preferably formed of a flexible and nonconductive material, has a front side 12, a right side 14, a left side 16, a solid rear side 18, and a base 20. A substantially cylindrical bore 22 is provided through the housing 10 from the left side 16 to the right side 14. The cylindrical bore 22 is adapted to receive an arc lamp end fitting 52, as later described in detail.

Provided in the front side 12 is a gap 24 which extends from the left side 16 to the right side 14 and which terminates in the cylindrical bore 22. The gap 24 is adapted to receive a female electrical connector 50, as later described in detail. Also formed in the front side 12 is slot 26 which together with a bore 27 forms an electrical connector container 29. The electrical connector container 29 is substantially transverse to cylindrical bore 22 and terminates therein. Positioned within the electrical connector container 29 is a male electrical connector 30, as shown in the front view of FIG. 2B. A lower end of the electrical connector container 29 serves as an outlet portion 28 through which a wire connector 31 (such as, for example, a wire) passes to connect the male electrical connector 30 to a power supply (not shown).

The male electrical connector 30 is a conductor which is adapted to transmit current supplied to it from an external power supply via the wire connector 31. The wire connector 31 is connected to the power supply and to the male connector 30 via the outlet portion 28 in such a manner that the connections can not be readily disengaged. Preferably, the wire connector 31 is integrally connected to the power supply and/or the male connector 30. The male connector 30 will transmit current supplied thereto by the power supply when it contacts another conductor such as, for example, a socket 51 of a female electrical connector 50, as later described in detail.

Figures 2A, 2B, 2C:
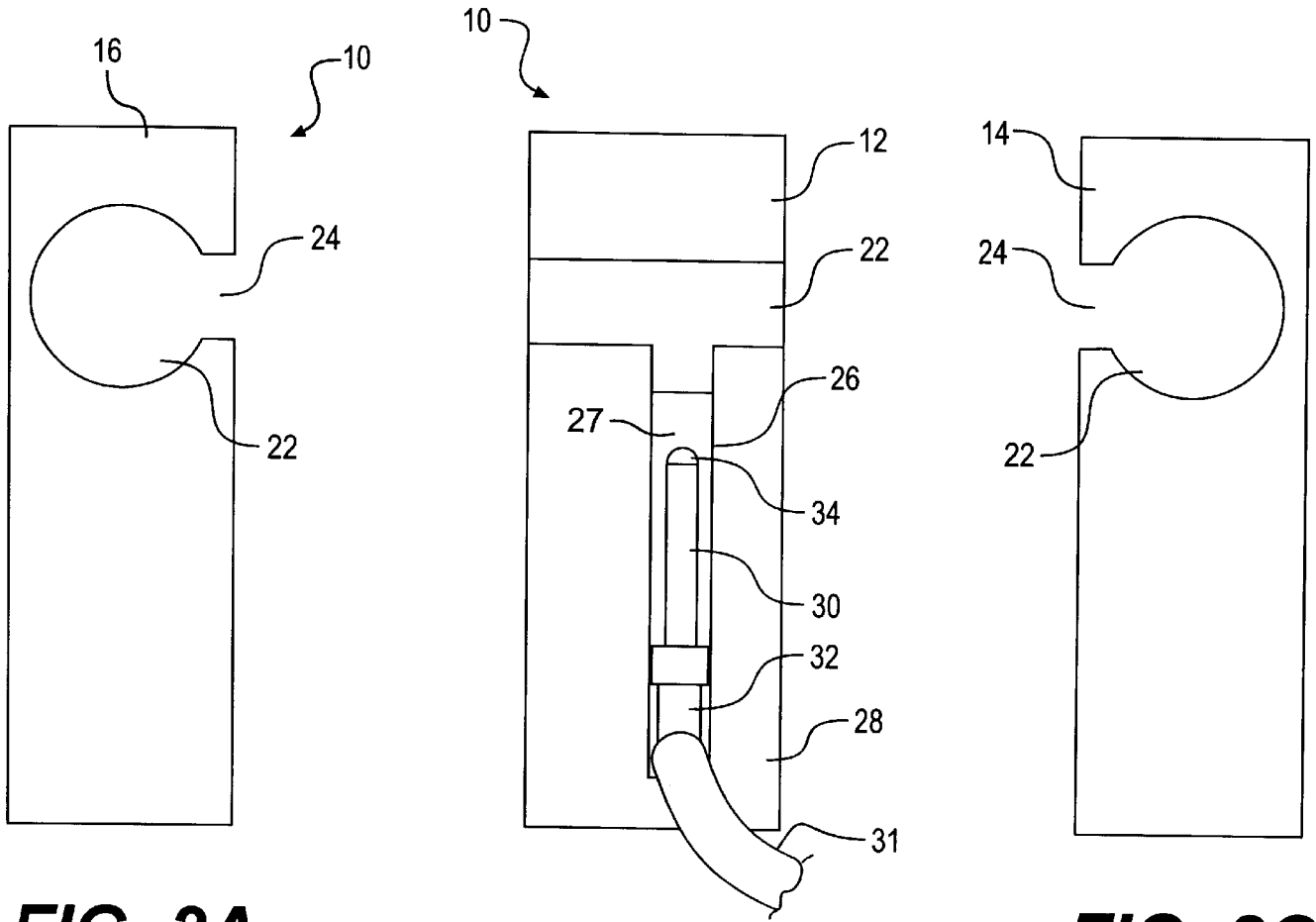
FIG. 2A shows a left side view of the connective housing of FIG. 1.
FIG. 2B shows a front view of the connective housing of FIG. 1, the front view showing a male electrical connector being positioned within the housing.
FIG. 2C shows a right side view of the connective housing of FIG. 1.
Figure 6A:
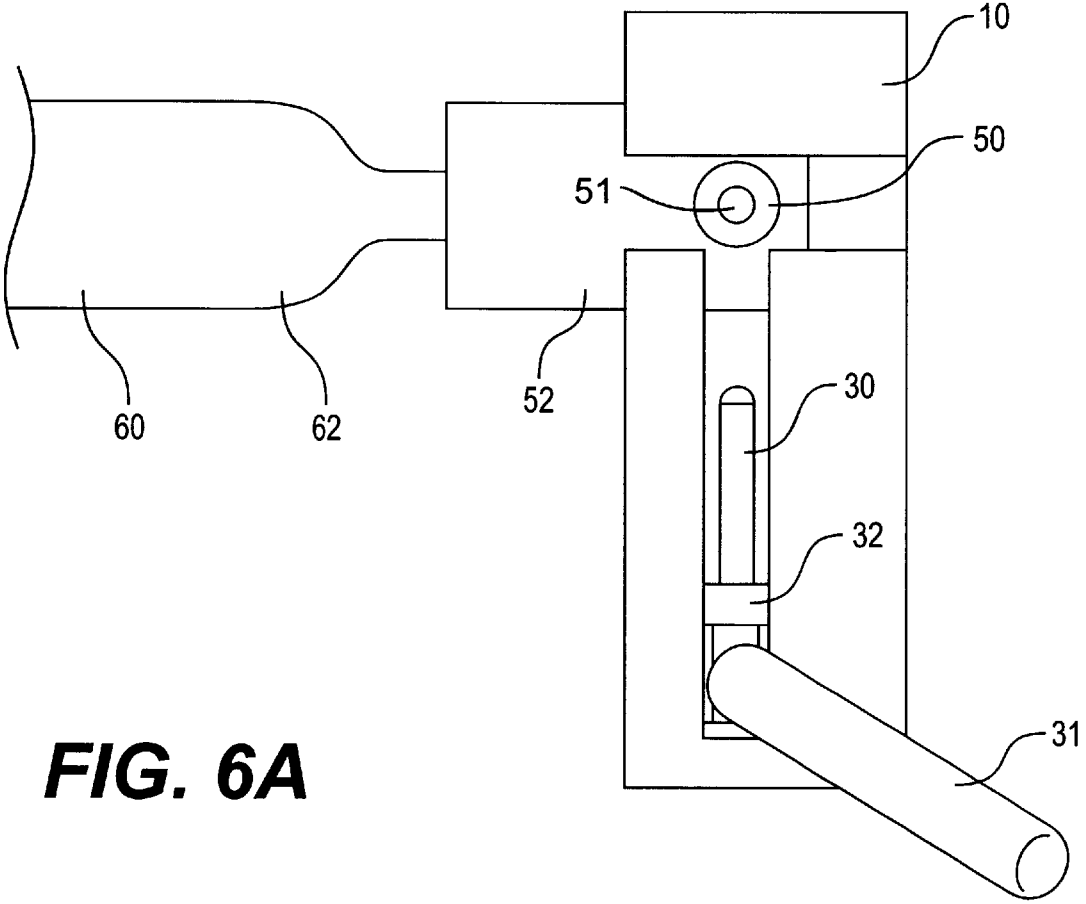
FIG. 6A is a front view of a male connector in the housing of FIG. 2 being positioned below a female electrical connector, the female electrical connector projecting out of the housing via a gap formed in the front side thereof.

Preferably, the male electrical connector 30 is spring loaded, i.e., it is biased by a spring 32, positioned adjacent a lower end thereof, to project upward toward the cylindrical bore 22, as shown in FIGS. 2B and 6A. Further, the male electrical connector 30 may be electrically connected to the spring 32 which, in turn, may be electrically connected to wire connector 31.

Figure 6B:
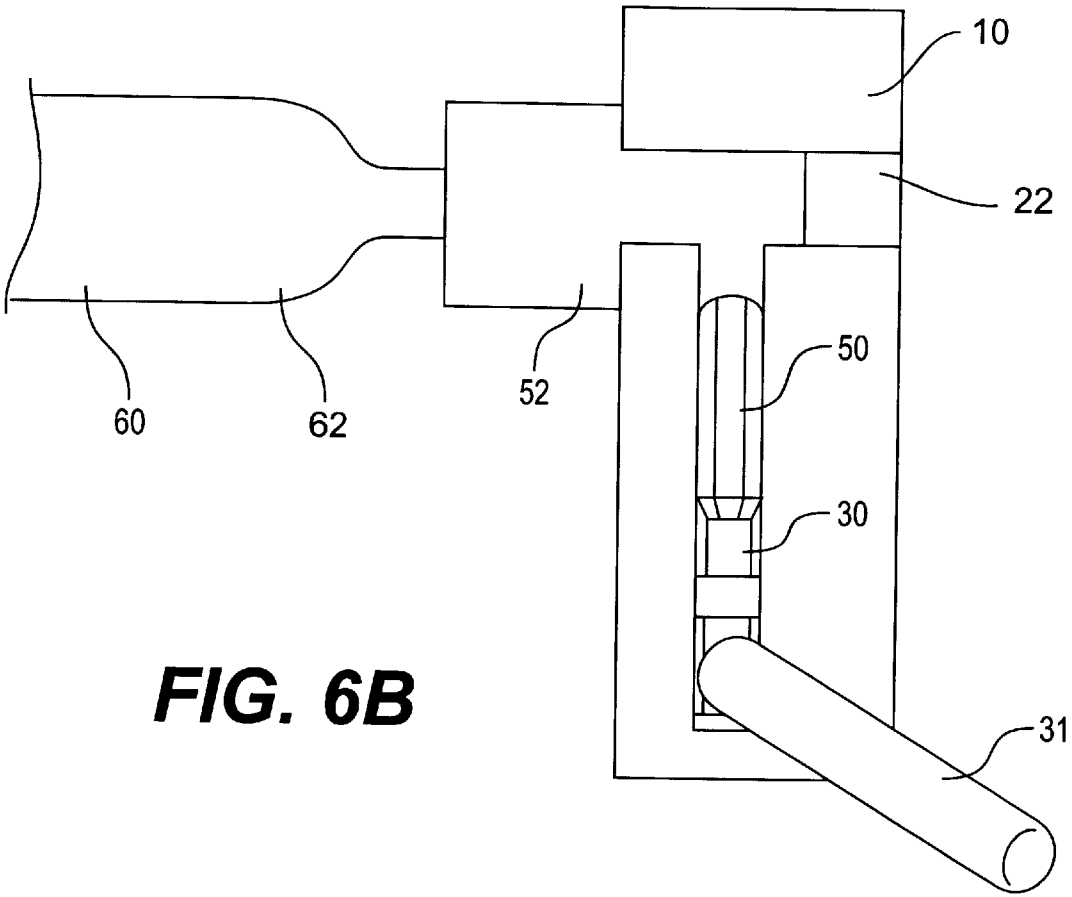
FIG. 6B is a front view of the female and male electrical connectors of FIG. 6A wherein the lamp has been turned thereby forcing the female connector into contact with the male electrical connector; the female electrical connector forcing the top end of male connector downward thereby compressing a spring positioned adjacent a lower end of the male connector.
Figure 7B:
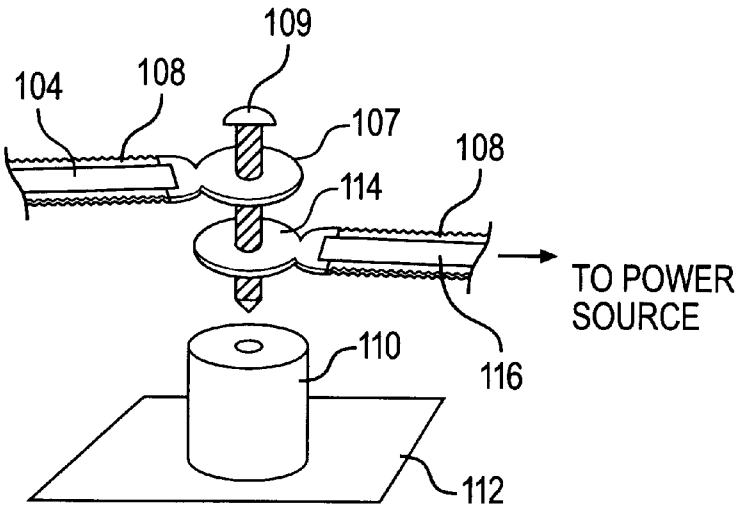
FIG. 7B PRIOR ART
FIG. 7B is a perspective view of an electrical connection between an electrical connector of the prior art embodiment shown in FIG. 7A and a power line integrally connected to a power source.
Figure 7A:
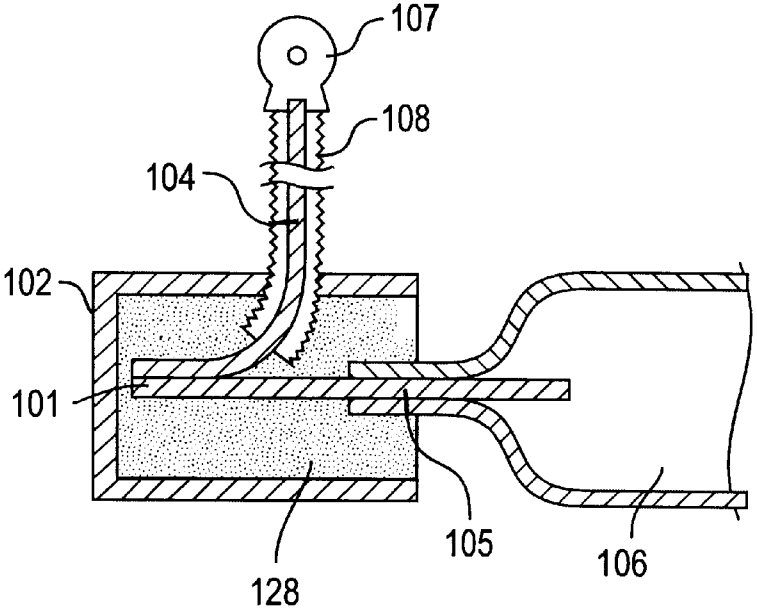
FIG. 7A PRIOR ART
FIG. 7A is cross-sectional view of a first prior art embodiment in which an electrical connection is established between an arc lamp electrode and an end fitting.
Figure 8B:
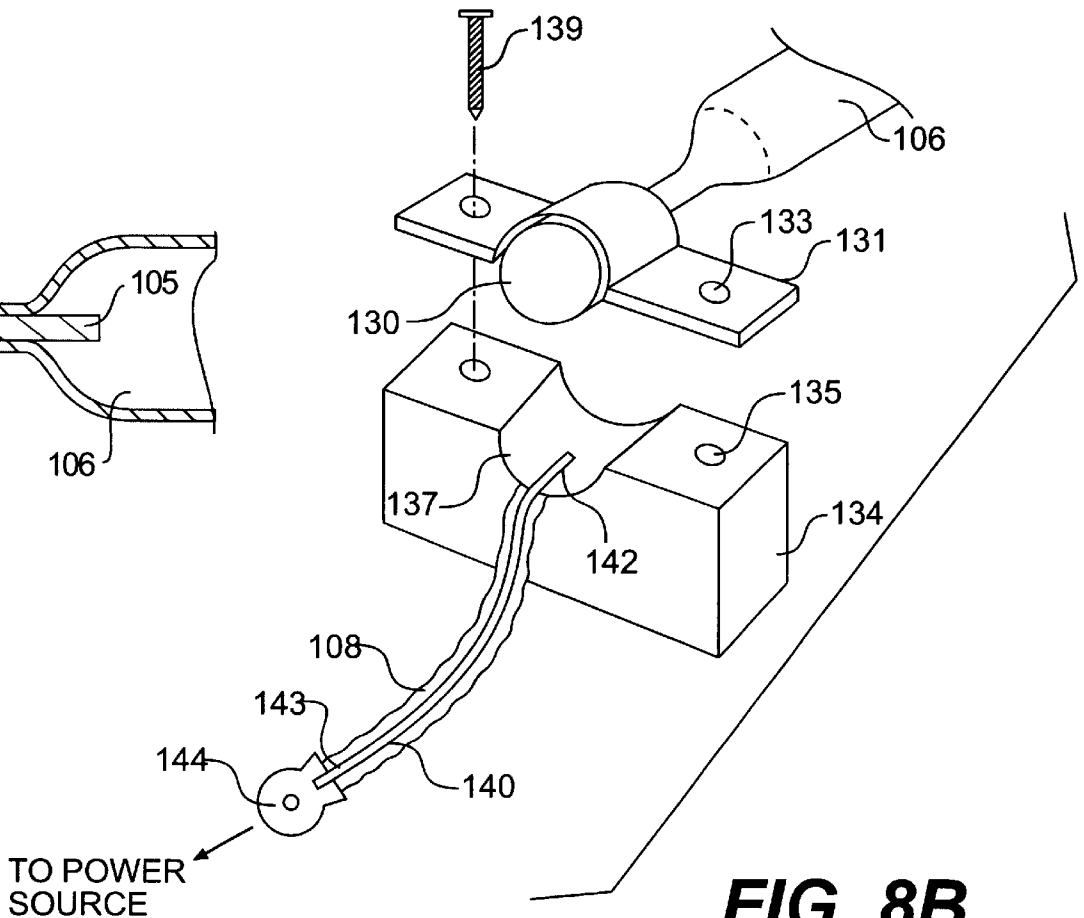
FIG. 8B PRIOR ART
FIG. 8B is a perspective view of an electrical connection between the end fitting of FIG. 8A and an insulating block which, in turn, is adapted to be connected to a power line.
Figure 8A:
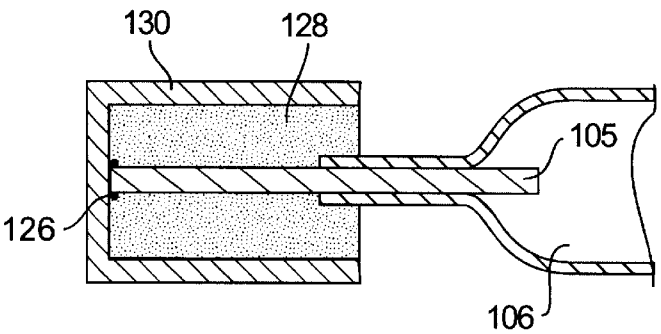
FIG. 8A PRIOR ART
FIG. 8A is a cross-sectional view of a second prior art embodiment in which an electrical connection is established between an arc lamp electrode and an end fitting.

The top end 34 of the male electrical connector 30 is preferably rounded or inclined in shape such that when an object (such as, for example, a female electrical connector 50) strikes the end 34 from the side or at an angle, the male electrical connector 30 will be forced (against the action of the spring 32) downward in the electrical connector container 29, as shown in FIG. 6B. However, as a result of the force exerted by the spring 32, the top end 34 will remain in contact with the object which forces the male electrical connector 30 downward in the electrical connector container 29. As will be clearer later, if the object which depresses the male electrical connector 30 is a female electrical connector 50 and if the female electrical connector 50 is rotated far enough, the male electrical connector 50 will be adapted to engage a socket 51 formed on the end of the female electrical connector 50, thereby establishing a stable electrical connection between the male and female electrical connectors 30, 50.

Figure 3A:
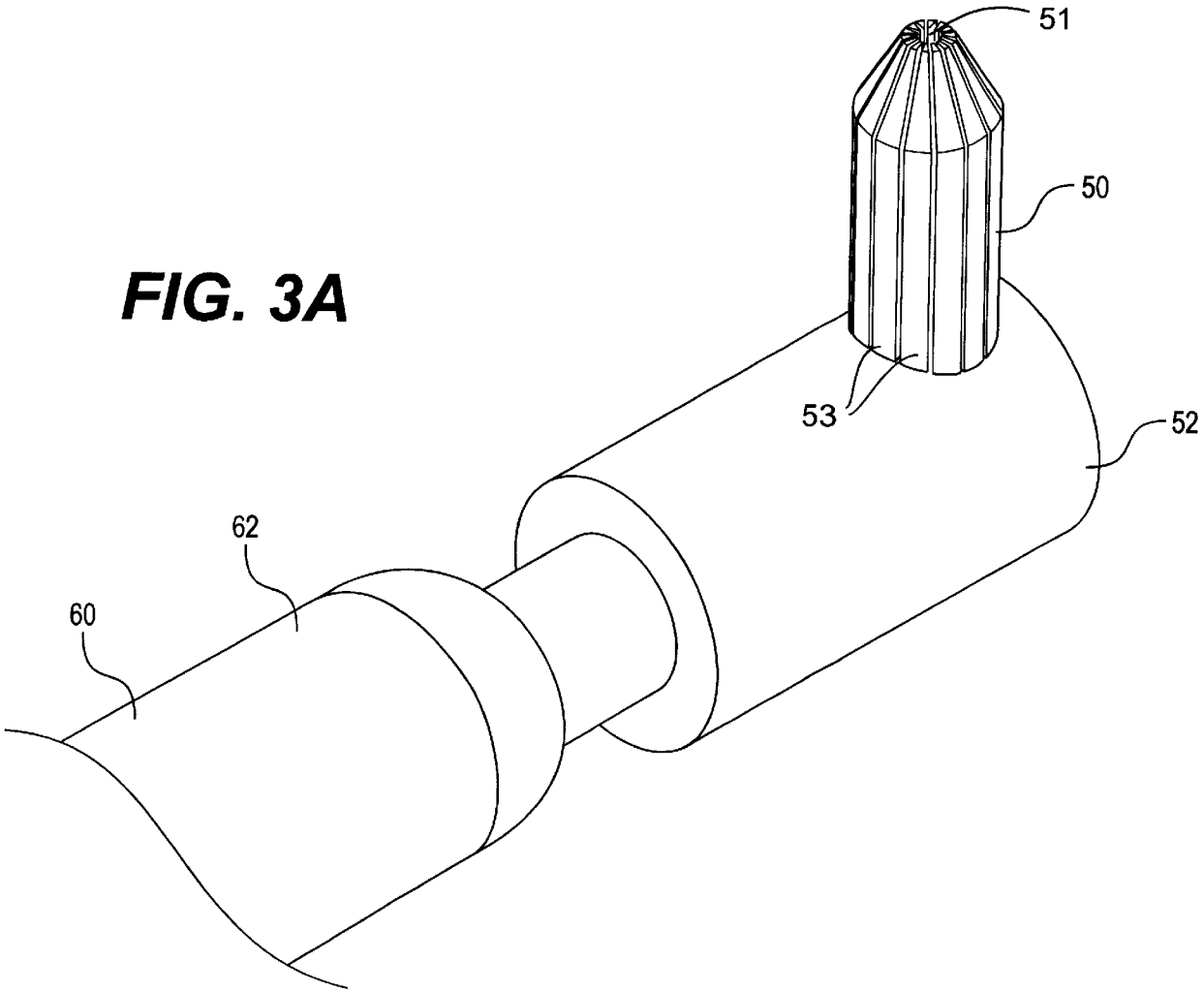
FIG. 3A is a perspective end view of an arc lamp having an end fitting projecting therefrom which, in turn, has a female electrical connector thereon, the female connector being adapted to engage the male connector shown in FIG. 2.
Figure 3B:
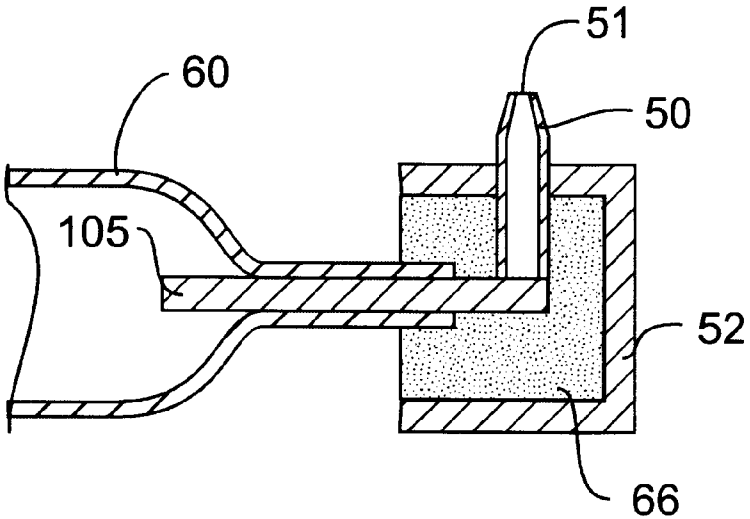
FIG. 3B is a cross-sectional view of a preferred embodiment of the arc lamp end fitting and female electrical connector of FIG. 3A.

FIG. 3A is a perspective end view of a right end 62 of an arc lamp 60 having an arc lamp end fitting 52 projecting therefrom. A female electrical connector 50, which has a socket 51 therein and which projects from the arc lamp end fitting 52, is adapted to contact, and to engage electrically, the conductive male electrical connector 30. In one embodiment, shown in FIG. 3B, the arc lamp end fitting 52 contains a nonconductive potting material 66 into which the female electrical connector 50 projects to establish electrical contact with an electrode 105 of the lamp 60. Further, the female electrical connector 50 may be soldered, brazed, crimped, stake, clamped, etc., onto the electrode 105 projecting from the end of the lamp 60.

Figure 4:
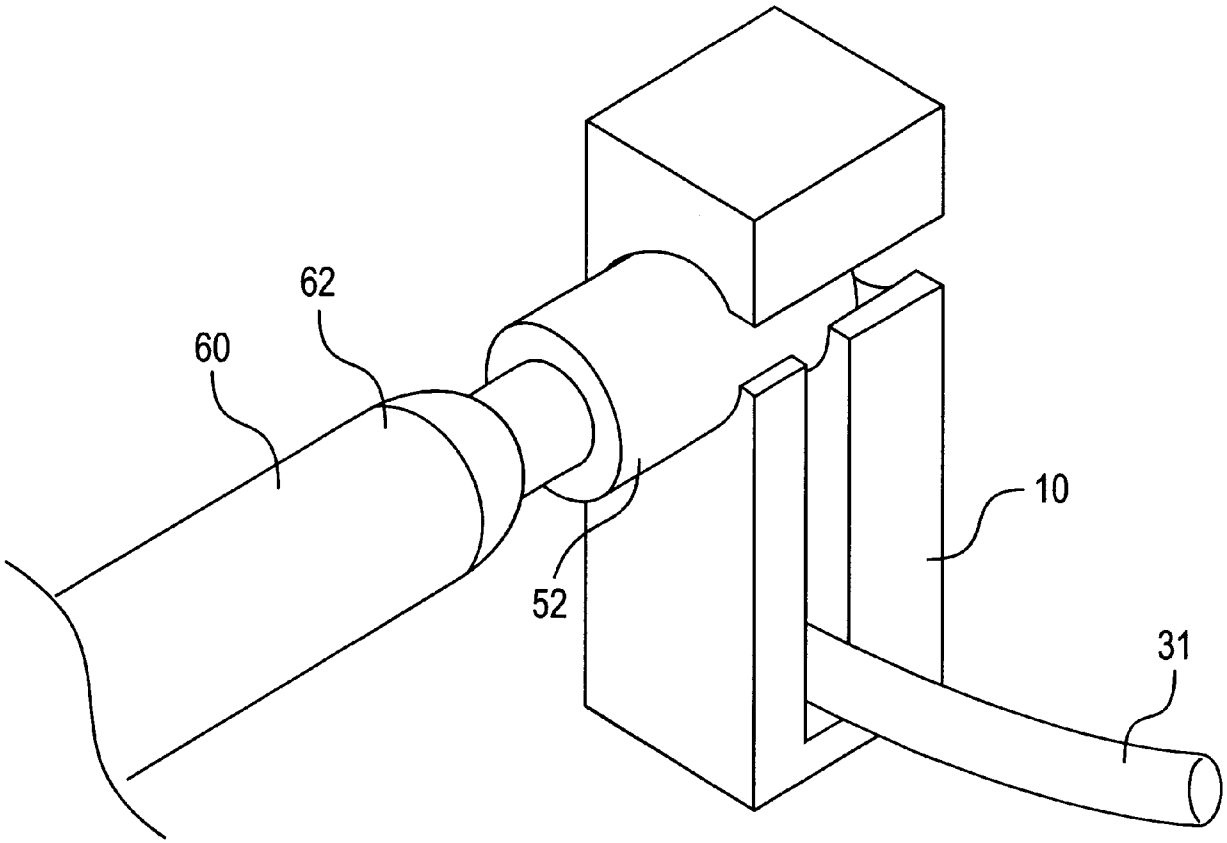
FIG. 4 is a perspective view of the right endof the arc lamp of FIG. 3 being engaged with the housing of FIGS. 1 and 2.

As shown in FIG. 4, the arc lamp end fitting 52, which projects from a right end 62 of the arc lamp 60, is designed to slide into the cylindrical bore 22. The cylindrical bore 22 has a diameter which is substantially the same as, but slightly greater than, the diameter of the arc lamp end fitting 52. The arc lamp end fitting 52 will slide into the bore 22, provided the female electrical connector 50 projecting therefrom is aligned with the gap 24. When the arc lamp end fitting 52 is sufficiently pushed into the cylindrical bore 22, the female electrical connector 50 projecting therefrom will align with the electrical connector container 29, as shown in FIG. 6A. At this point, the lamp 60 may be rotated so that the female electrical connector 50 may swing downward into the electrical connector container 29. Further, as the female electrical connector 50 swings downward, it will force the top end 34 of the male electrical connector 30 downward into the electrical connector container 29. With a continued rotation of the female electrical connector 50, the male electrical connector 30 will align with, and thereafter engage, the socket 51 formed in the end of the female electrical connector 50, as shown in FIG. 6B.

When female electrical connector 50 contacts and pushes the male electrical connector 30, an electrical connection will be established between the female electrical connector 50 and the male electrical connector 30. Further, when the male electrical connector 30 engages the socket 51, a stable connection will be established. In one embodiment, the male electrical connector 30 may penetrate the socket 51, thereby forcing fan members 53 thereof to expand radially outward and increasing the contact between the male and female electrical connectors 30, 50. In addition, the stability of the connection is also enhanced because: (a) the vertical motion of the female electrical connector 50 is inhibited by arc lamp end fitting 52 abutting the wall of the cylindrical bore 22; and (b) the male electrical connector 30 is upwardly biased by the spring 32 into the female electrical connector 50. Accordingly, the electrical connection between the male electrical connector 30 and the female electrical connector 50 is continuously stable.

It is also possible to engage electrically the male electrical connector 30 and the female electrical connector 50 prior to positioning the arc lamp end fitting 52 in the housing 10. One way to achieve this result is to engage the male electrical connector and the socket 51 of the female electrical connector 50. After this is completed, the arc lamp end fitting 52 may be pushed into the cylindrical bore 22, provided the female electrical connector 50 (with the male electrical connector 30 attached thereto) is aligned with the gap 24. When the arc lamp end fitting 52 is pushed sufficiently into the housing 10 so that the male and female electrical connectors 30, 50 align with the slot 24, the spring 32 under the male electrical connector 30 may be compressed while the lamp 60 is rotated. If the spring 32 is sufficiently compressed, it will pass into the electrical connector container 29 along with the male and female electrical connectors 30, 50. Once the male and female electrical connectors 30, 50 are positioned in the electrical connector container 29, the spring 32 may be released allowing it to abut the bottom 20 of the housing; the spring 32 will not, however, extended to its uncompressed length.

Another method of connecting the male and female electrical connectors 30, 50 prior to inserting them in the housing would entail the following. The arc lamp end fitting 52 could be positioned against the gap 24 so that the male and female electrical connectors 30, 50 are aligned with the slot 26. If the housing 10 is sufficiently pliable, the top side thereof can be temporarily pushed upward by the arc lamp end fitting 52 so that the arc lamp end fitting 52 snaps into the cylindrical bore 22, moving in a direction from the front side 12 toward the rear side 18. When the arc lamp end fitting 52 is received by the bore 22, the lamp 60 could be rotated and the spring 32 compressed in a manner similar to that previously described so that the male and female electrical connectors 30, 50 can rotate into the electrical connector container 29.

Figure 5:
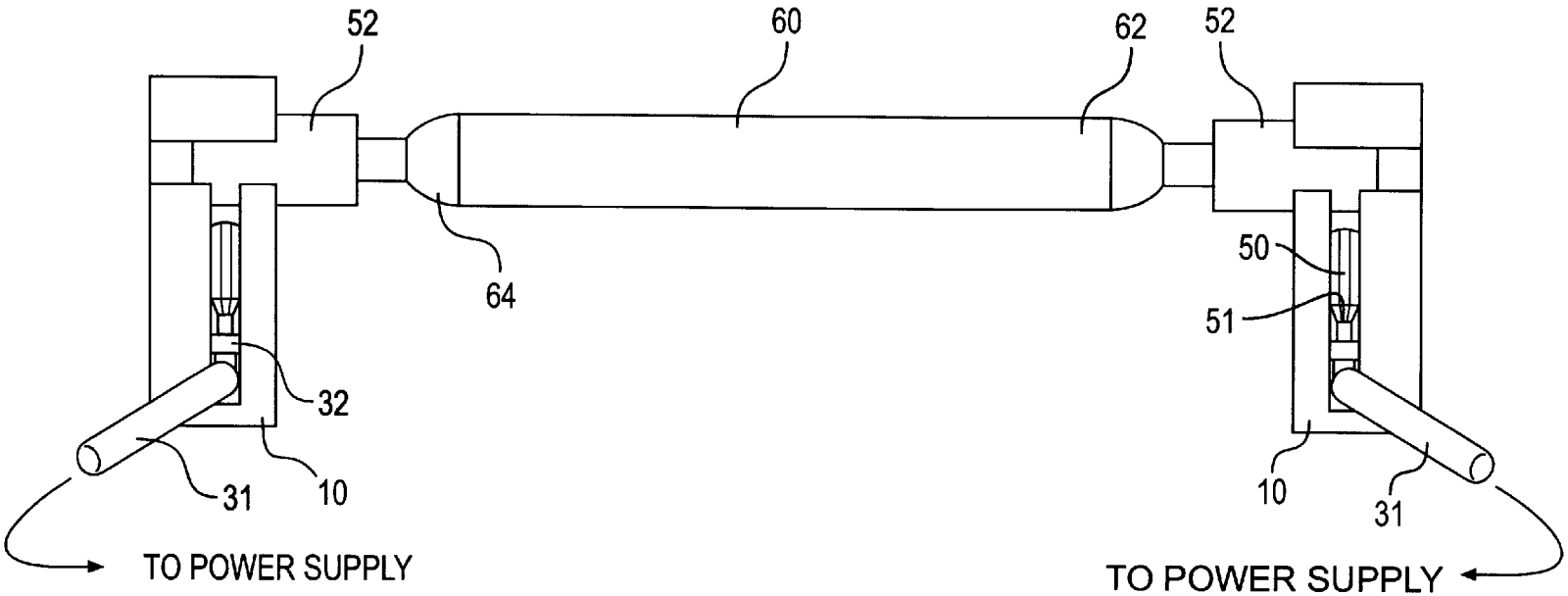
FIG. 5 is a front view of the arc lamp of FIG. 3 being engaged on a right endthereof with the housing of FIGS. 1 and 2 and on a left end thereof with another housing having a second male electrical connector therein.

It should be readily apparent that a left end 64 of the arc lamp 60 can be similarly engaged to another housing 10. When the housings 10 are identical, one possible method of inserting the arc lamp end fittings 52 on the lamp 60 into each of the cylindrical bores 22 in the two housings 10 may entail enabling at least one of the housings 10 to be mobile. In this embodiment, the arc lamp end fitting 52 on a first end 62 of the lamp 60 could slide into the cylindrical bore 22 in the housing 10 associated therewith and then the second housing 10 could then slide onto the arc lamp end fitting 52 on the other end 64 of the lamp 60. The arc lamp 60 could then be rotated so as to force the female electrical connectors 50 downward into the respective electrical connector containers 29, thereby establishing electrical connections with the respective male electrical connectors 30, as shown in FIG. 5. Thereafter the second housing 10 may be immobilized (if desired), for example, by fastening it to a surface (not shown).

In another embodiment, however, each of the housings may be identical (to reduce manufacturing cost) and may be permanently affixed to a surface (not shown), so that the apparatus will be more readily usable. In this embodiment, the diameter of the cylindrical bore 22 may not only be slightly greater than the diameter of the arc lamp end fitting 52 projecting from both ends of a lamp 60, it may also be greater than the diameter of the light emitting portion of the lamp 60.

In this embodiment, to establish an electrical connection between the male and female electrical connectors 30, 50 in each of the housings 10, the arc lamp end fitting 52 on one end of the lamp 60 may be pushed entirely through the outer side of a first of the two housings 10. The lamp 60 will continue to be pushed until that arc lamp end fitting 52 is received in the cylindrical bore 22 in the second of the two housings 10. At that time, the other arc lamp end fitting 52 will be received in the first housing 10. As with the previously described embodiment, when the female connectors 50 are aligned with the electrical connector containers 29, the lamp 60 may be rotated to force the female electrical connectors 50 downward into the electrical connector containers 29 to engage the male electrical connectors 30, thereby creating the connection shown in FIG. 5.

In addition, either of the two previously discussed methods of connecting a male 30 and a female 50 electrical connector prior to immobilizing the connection in a housing 10 can be incorporated into any of the previously discussed methods of creating electrical connections on both ends of the arc lamp 60. For example, if two immobile housings 10 are provided, the each male and female electrical connector 30, 50 could be connected to its respective male and female electrical connector 30, 50. At that time, a first of the two arc lamp end fittings 52 could be pushed through a first of the housings 10 and into a second of the housings 10, at which time the other arc lamp end fitting 52 will be received in the first housing 10. When the joined male and female electrical connectors 30, 50 are aligned with their respective electrical connector container 29, the springs 32 under the male electrical connectors 30 may be depressed and the lamp 60 rotated so that the male and female electrical connectors 30, 50 are received in their respective electrical connector containers 29, at which time the compression of the springs 32 may be discontinued.

As the male electrical connectors 30 are integrally connected to a power supply, the present invention eliminates the need for the insulating standoffs 110, fasteners 109 (e.g., screw), and the need to use tools (e.g., screwdriver) to secure the connection. To maintain the integral electrical connection between a housing 10 and a power source, the spring 32 (which is electrically connected to the male electrical connector 30) must withstand the temperature of the environment inside the housing 10, resist corrosion, and be compatable with the material (and any plating thereof) forming the electrical connector container 26.

Although the aforementioned describes embodiments of the invention, the invention is not so restricted. It will be apparent to those skilled in the art that various modifications and variations can be made to the disclosed preferred embodiments of the present invention without departing from the scope or spirit of the invention. For example, although the aforementioned electrical connection between the male electrical connector 30 and the female electrical connector 50 was described with respect to an arc lamp, the invention is not limited to arc lamps. Rather, the electrical connection could be used in any circuit requiring a connection between two or more electrical connectors. In addition, although the housing has been described as a multisided structure, it can be any shape provided it satisfies the electrical engagements previously discussed. Accordingly, it should be understood that the apparatus and method described herein are illustrative only and are not limiting upon the scope of the invention, which is indicated by the following claims.

What is claimed is:

1. A connective apparatus for an electrical connection, the apparatus comprising:

a housing comprising:

a bore through the housing which is adapted to receive an arc lamp end fitting having a female electrical connector projecting therefrom; and an electrical connector container having one end in communication with the bore; and a male electrical connector provided in the electrical connector container, wherein a first portion of the male electrical connector is adapted to engage electrically the female electrical connector, and wherein a second portion the male connector is electrically connected to a power supply.

2. The apparatus according to claim 1, wherein the electrical connector container is substantially transverse to the bore.

3. The apparatus according to claim 1, wherein the male electrical connector comprises a spring provided adjacent the second portion.

4. The apparatus according to claim 3, wherein the first portion of the male electrical connector is biased by the spring toward the bore.

5. The apparatus according to claim 4, wherein when the arc lamp end fitting is positioned in the bore, the first portion of the male connector, which electrically engages the female electrical connector, is adapted to be driven downward in the electrical connector container by the female electrical connector.

6. The apparatus according to claim 1, wherein the electrical connection between the second portion of the male connector and the power supply can not be readily disengaged.

7. The apparatus according to claim 1, wherein the second portion of the male connector is integrally connected to the power supply.

8. The apparatus according to claim 1, wherein the housing is formed of a nonconductive material.

9. The apparatus according to claim 1, wherein a front side of the housing has a gap formed therein which extends into the bore, and wherein the gap is adapted to receive the female electrical connector.

10. The apparatus according to claim 1, wherein the female electrical connector comprises a socket which is adapted to receive and to engage electrically the male electrical connector.

11. An arc lamp apparatus comprising:

an arc lamp comprising:

a first end comprising a first arc lamp end fitting having a first female electrical connector projecting therefrom;

a second end; and a light emitting portion positioned between the first and second ends;

a first connective apparatus comprising:

a first housing comprising:

a first bore through the first housing in which the first arc lamp end fitting is positioned; and a first electrical connector container having one end in communication with the first bore; and a first male electrical connector provided in the first container, wherein a first portion of the first male electrical connector electrically engages the first female electrical connector, and wherein a second portion the first male connector is electrically connected to a power supply.

12. The arc lamp apparatus according to claim 11, wherein the first electrical connector container is substantially transverse to the first bore.

13. The arc lamp apparatus according to claim 11, wherein the first male electrical connector comprises a spring provided adjacent the second portion thereof.

14. The arc lamp apparatus according to claim 13, wherein the first portion of the first male electrical connector is biased by the spring toward first bore of the first housing.

15. The arc lamp apparatus according to claim 11, wherein the second end of the arc lamp comprises a second arc lamp end fitting having a second female electrical connector projecting therefrom, and wherein the arc lamp apparatus further comprises:

a second connective apparatus comprising:

a second housing comprising:

a second bore through the second housing in which the second arc lamp end fitting is positioned; and a second electrical connector container having one end in communication with the second bore; and a second male electrical connector provided in the second container, wherein a first portion of the second male electrical connector electrically engages the second female electrical connector, and wherein a second portion the second male connector is electrically connected to the power supply.

16. The arc lamp apparatus according to claim 15, wherein the second male electrical connector comprises a spring provided adjacent the second portion thereof.

17. The arc lamp apparatus according to claim 16, wherein when the first arc lamp end fitting is positioned in the first bore of the first housing, the first portion of the first male connector, which electrically engages the first female electrical connector, is driven downward in the first container of the first housing by the first female electrical connector.

18. The arc lamp apparatus according to claim 15, wherein the electrical connections between the second portions of the first and second male connectors and the power supply can not be readily disengaged.

19. The arc lamp apparatus according to claim 15, wherein the second portions of the first and second male connectors are integrally connected to the power supply.

20. The arc lamp apparatus according to claim 15, wherein the first and second housings are formed of a nonconductive material.

21. A method of connecting an arc lamp to a power supply comprising the steps of:

moving a first end of an arc lamp through a first bore in a first housing, the first end of the arc lamp comprising a first arc lamp end fitting having a first female electrical connector projecting therefrom;

moving the first end of the arc lamp into a second bore in a second housing;

moving a second end of the arc lamp into the first bore in the first housing, the second end of the arc lamp comprising a second arc lamp end fitting having a second female electrical connector projecting therefrom;

aligning the first female electrical connector with a slot in the second housing while simultaneously aligning the second female electrical connector with a slot in the first housing;

rotating the arc lamp so as to position the first female electrical connector in the slot in the second housing and so as to position the second female electrical connector in the slot in the first housing;

engaging, electrically, the first female electrical connector with a first male electrical connector in the second housing, wherein the first male electrical connector is electrically connected to a power source; and engaging, electrically, the second female electrical connector with a second male electrical connector in the first housing, wherein the second male electrical connector is electrically connected to the power source.

22. The method according to claim 21, wherein the first female electrical connector comprises a socket which electrically engages the first male electrical connector, and wherein the second female electrical connector comprises a socket which electrically engages the second male electrical connector.

23. The method according to claim 22, wherein the first male electrical connector is provided in the slot in the second housing, and wherein the second male electrical connector is provided in the slot in the first housing.

24. A method of connecting one end of an arc lamp to a power supply comprising the steps of:

moving an arc lamp end fitting projecting from the end of the arc lamp into a bore in a housing, wherein the arc lamp end fitting has a female electrical connector projecting therefore;

aligning the female electrical connector with an electrical connector container in the housing, wherein a male electrical connector is provided in the electrical connector container;

rotating the arc lamp so as to force the female electrical connector into the electrical connector container;

contacting the female electrical connector and the male electrical connector; and establishing an electrical connection between the male electrical connector and the female electrical connector.

25. The method according to claim 24, wherein the step of contacting the female and male electrical connectors comprises:

compressing a spring provided below the male electrical connector in the housing.

26. The method according to claim 25, wherein the male electrical connector is connected to a power supply.

27. The method according to claim 24, wherein the step of establishing an electrical connection between the male and female electrical connectors comprises:

moving an end portion of male electrical connector into a socket formed in an end of the female electrical connector.

28. A method of connecting one end of an arc lamp to a power supply comprising the steps of:

positioning an arc lamp end fitting projecting from the end of the arc lamp against a gap in a housing, wherein a bore is provided behind the gap, wherein the arc lamp end fitting has a female electrical connector projecting therefore;

pushing the arc lamp end fitting through the gap and into the bore;

aligning the female electrical connector with an electrical connector container in the housing, wherein a male electrical connector is provided in the electrical connector container;

rotating the arc lamp so as to force the female electrical connector into the electrical connector container;

contacting the female electrical connector and the male electrical connector; and establishing an electrical connection between the male electrical connector and the female electrical connector.

29. The method according to claim 28, wherein the step of contacting the female and male electrical connectors comprises:

compressing a spring provided below the male electrical connector in the housing.

30. The method according to claim 28, wherein the male electrical connector is connected to a power supply.

31. The method according to claim 28, wherein the step of establishing an electrical connection between the male and female electrical connectors comprises:

moving an end portion of male electrical connector into a socket formed in an end of the female electrical connector.

32. The method according to claim 28, wherein the housing is formed of a pliable material, and wherein the step of pushing the arc lamp end fitting through the gap and into the bore comprises:

expanding a width of the gap to be as wide as a width of the arc lamp end fitting;

moving the arc lamp end fitting into the bore; and returning the gap to its original width.

* * * * *

US006712629C1

(12) EX PARTE REEXAMINATION CERTIFICATE (5407th)

United States Patent

Alexander et al.

(10) Number: US 6,712,629 C1

(45) Certificate Issued: Jun. 13, 2006

(54) APPARATUS AND METHOD OF MAKING AN ELECTRICAL CONNECTION IN A HIGH VOLTAGE/HIGH CURRENT LAMP

(75) Inventors: Charles Alexander, Cincinnati, OH (US); Mark Tausch, West Chester, OH (US); Thomas Wallenhorst, Liberty Township, OH (US)

(73) Assignee: Delaware Capital Formation, Inc., Wilmington, DE (US)

Reexamination Request:
No. 90/007,122, Jul. 19, 2004

Reexamination Certificate for:

| | |
|---|---|
| Patent No.: | **6,712,629** |
| Issued: | **Mar. 30, 2004** |
| Appl. No.: | **10/284,487** |
| Filed: | **Oct. 31, 2002** |

Related U.S. Application Data

(60) Provisional application No. 60/418,193, filed on Oct. 15, 2002.

(51) Int. Cl.
*H01R 33/02* (2006.01)

(52) U.S. Cl. ..... 439/244; 439/240; 439/241

(58) Field of Classification Search ..... 439/232, 439/233, 239–44; 362/416
See application file for complete search history.

(56) References Cited

U.S. PATENT DOCUMENTS

| | | | | |
|---|---|---|---|---|
| 1,744,369 | A | | 1/1930 | Dietz et al. |
| 2,108,633 | A | * | 2/1938 | Wiegand et al. ..... 439/239 |
| 2,393,616 | A | * | 1/1946 | De Reamer et al. ..... 439/243 |
| 3,344,390 | A | * | 9/1967 | Dell ..... 439/242 |
| 3,727,040 | A | | 4/1973 | Armstrong et al. |
| 3,733,709 | A | | 5/1973 | Bassemir et al. |
| 3,783,261 | A | | 1/1974 | Hartmann |
| 3,819,929 | A | | 6/1974 | Newman |
| 3,900,727 | A | | 8/1975 | Hutz ..... 362/263 |
| 3,967,385 | A | | 7/1976 | Culbertson |
| 4,149,086 | A | | 4/1979 | Nath |
| 4,422,100 | A | | 12/1983 | DuVall et al. |
| 4,443,836 | A | | 4/1984 | Horiuchi et al. |
| 4,563,589 | A | | 1/1986 | Scheffer |
| 4,574,337 | A | | 3/1986 | Poppenheimer |
| 4,604,680 | A | | 8/1986 | Levin et al. |
| 4,644,899 | A | | 2/1987 | Glaus |
| 5,216,820 | A | | 6/1993 | Green et al. ..... 34/273 |
| 5,339,226 | A | | 8/1994 | Ishikawa |
| 5,355,198 | A | | 10/1994 | Saito |
| 5,394,317 | A | | 2/1995 | Grenga et al. |
| 5,414,601 | A | | 5/1995 | Davenport et al. |
| 5,440,137 | A | | 8/1995 | Sowers |
| 5,510,964 | A | * | 4/1996 | Spitler et al. ..... 439/232 |
| 5,825,041 | A | | 10/1998 | Belek et al. |
| 5,932,886 | A | | 8/1999 | Arai et al. |
| 6,076,943 | A | | 6/2000 | Lassovsky |
| 6,474,837 | B1 | | 11/2002 | Belliveau |
| 6,572,370 | B1 | | 6/2003 | Hampden |
| 6,621,087 | B1 | | 9/2003 | Bisges et al. |
| 6,646,278 | B1 | | 11/2003 | Schwarz et al. |
| 6,719,444 | B1 | | 4/2004 | Alber et al. |
| 6,720,566 | B1 | | 4/2004 | Blandford |

OTHER PUBLICATIONS

B. J. Ronkese, "Metal Wool and Indium Heat Sink," IBM Technical Disclosure Bulletin, vol. 21, Issue No. 3, pp. 1143–1144, Aug. 1, 1978.

* cited by examiner

*Primary Examiner*—Renee Luebke

(57) ABSTRACT

A housing is provided in which a first electrical connector is positioned, the first connector being connected to a power supply. A second electrical connector is designed to be received by the housing so that a substantially stable and continuous electrical connection is established between the first and second electrical connectors.

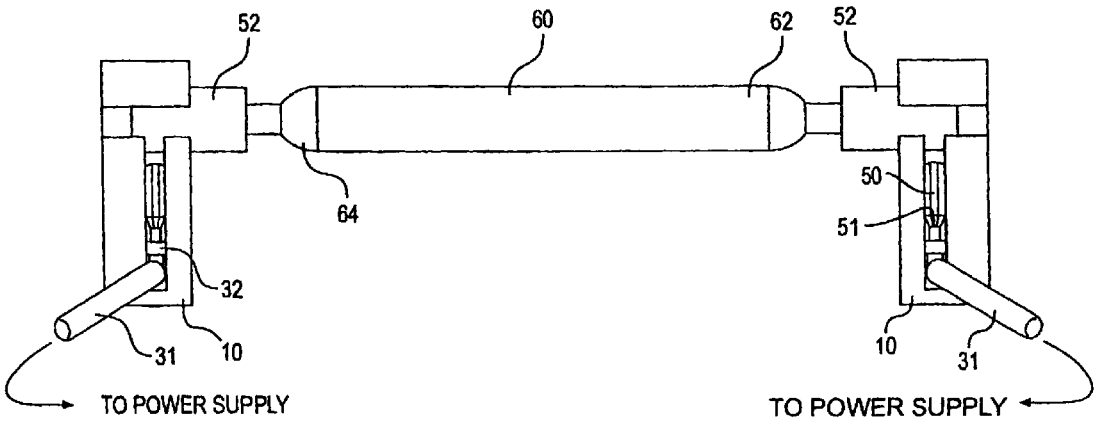

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 8, lines 39–55:

The top end 34 of the male electrical connector 30 is preferably rounded or inclined in shape such that when an object (such as, for example, a female electrical connector 50) strikes the end 34 from the side or at an angle, the male electrical connector 30 will be forced (against the action of the spring 32) downward in the electrical connector container 29, as shown in FIG. 6B. However, as a result of the force exerted by the spring 32, the top end 34 will remain in contact with the object which forces the male electrical connector 30 downward in the electrical connector container 29. As will be clearer later, if the object which depresses the male electrical connector 30 is a female electrical connector 50 and if the female electrical connector 50 is rotated far enough, the male electrical connector [50] *30* will be adapted to engage a socket 51 formed on the end of the female electrical connector 50, thereby establishing a stable electrical connection between the male and female electrical connectors 30, 50.

AS A RESULT OF REEXAMINATION, IT HAS BEEN DETERMINED THAT:

The patentability of claims 21–23 is confirmed.

Claims 2 and 12 are cancelled.

Claims 1, 11, 15, 24 and 28 are determined to be patentable as amended.

Claims 3–10, 13, 14, 16–20, 25–27 and 29–32, dependent on an amended claim, are determined to be patentable.

1. A connective apparatus for an electrical connection, the apparatus comprising:

a housing comprising:

a bore through the housing which is adapted to receive an arc lamp end fitting having a female electrical connector projecting therefrom; and an electrical connector container having one end in communication with the bore; and a male electrical connector provided in the electrical connector container, wherein a first portion of the male electrical connector is adapted to engage electrically the female electrical connector, and wherein a second portion *of* the male connector is electrically connected to a power supply,

*wherein the electrical connector container is substantially transverse to the bore.*

11. An arc lamp apparatus comprising:

an arc lamp comprising:

a first end comprising a first arc lamp end fitting having a first female electrical connector projecting therefrom;

a second end; and a light emitting portion positioned between the first and second ends;

a first connective apparatus comprising:

a first housing comprising:

a first bore through the first housing in which the first arc lamp end fitting is positioned; and a first electrical connector container having one end in communication with the first bore; and a first male electrical connector provided in the first container, wherein a first portion of the first male electrical connector electrically engages the first female electrical connector, and wherein a second portion *of* the first male connector is electrically connected to a power supply,

*wherein the first electrical connector container is substantially transverse to the first bore.*

15. The arc lamp apparatus according to claim 11, wherein the second end of the arc lamp comprises a second arc lamp end fitting having a second female electrical connector projecting therefrom, and wherein the arc lamp apparatus further comprises:

a second connective apparatus comprising:

a second housing comprising:

a second bore through the second housing in which the second arc lamp end fitting is positioned; and a second electrical connector container having one end in communication with the second bore; and a second male electrical connector provided in the second container, wherein a first portion of the second male electrical connector electrically engages the second female electrical connector, and wherein a second portion *of* the second male connector is electrically connected to the power supply.

24. A method of connecting one end of an arc lamp to a power supply comprising the steps of:

moving an arc lamp end fitting projecting from the end of the arc lamp into a bore in a housing, wherein the arc lamp end fitting has a female electrical connector projecting [therefore] *therefrom*;

aligning the female electrical connector with an electrical connector container in the housing, wherein a male electrical connector is provided in the electrical connector container;

rotating the arc lamp so as to force the female electrical connector into the electrical connector container;

contacting the female electrical connector and the male electrical connector; and establishing an electrical connection between the male electrical connector and the female electrical connector.

28. A method of connecting one end of an arc lamp to a power supply comprising the steps of:

positioning an arc lamp end fitting projecting from the end of the arc lamp against a gap in a housing, wherein a bore is provided behind the gap, wherein the arc lamp end fitting has a female electrical connector projecting [therefore] *therefrom*;

pushing the arc lamp end fitting through the gap and into the bore;

aligning the female electrical connector with an electrical connector container in the housing, wherein a male electrical connector is provided in the electrical connector container;

rotating the arc lamp so as to force the female electrical connector into the electrical connector container;

contacting the female electrical connector and the male electrical connector; and establishing an electrical connection between the male electrical connector and the female electrical connector.

* * * * *